US008844064B2

(12) United States Patent
Robaire et al.

(10) Patent No.: US 8,844,064 B2
(45) Date of Patent: Sep. 30, 2014

(54) PROTECTIVE SPORTS GLOVE HAVING A SEGMENTED CUFF ROLL

(75) Inventors: Stephen J. Robaire, Jamaica Plain, MA (US); Tom Gernetzke, Charlestown, MA (US); Michael Tinstman, Malden, MA (US); Billy Vespa, Salem, MA (US)

(73) Assignee: Reebok International Limited, London (GB)

( * ) Notice: Subject to any disclaimer, the term of this patent is extended or adjusted under 35 U.S.C. 154(b) by 375 days.

(21) Appl. No.: 12/874,746

(22) Filed: Sep. 2, 2010

(65) Prior Publication Data

US 2012/0054937 A1 Mar. 8, 2012

(51) Int. Cl.
*A63B 71/14* (2006.01)
*A41D 19/00* (2006.01)

(52) U.S. Cl.
CPC ..... *A63B 71/148* (2013.01); *A63B 2243/005* (2013.01); *A63B 71/143* (2013.01); *A41D 19/0048* (2013.01)
USPC ..... 2/161.1; 2/16; 2/159

(58) Field of Classification Search
USPC ..... 2/16, 159, 160, 161.1, 161.6–161.8, 2/162, 164, 170
See application file for complete search history.

(56) References Cited

U.S. PATENT DOCUMENTS 4,484,359 A * 11/1984 Tirinen ..... 2/20
4,815,147 A * 3/1989 Gazzano et al. ..... 2/161.1
D387,505 S * 12/1997 Clement ..... D29/116.3
5,983,396 A * 11/1999 Morrow et al. ..... 2/161.1
D435,700 S * 12/2000 Wilder et al. ..... D29/116.3
D446,888 S * 8/2001 Morrow ..... D29/113
6,543,057 B2 * 4/2003 Beland et al. ..... 2/161.1
6,550,069 B1 * 4/2003 Morrow ..... 2/161.1
6,732,376 B2 * 5/2004 Hoffman ..... 2/161.1
6,813,780 B2 * 11/2004 Morrow ..... 2/161.1
6,959,453 B2 11/2005 Best
6,990,690 B2 1/2006 Gait
7,318,241 B2 1/2008 Morrow
D561,950 S * 2/2008 Jourde et al. ..... D29/123
D564,136 S * 3/2008 Jourde et al. ..... D29/123
7,406,719 B2 8/2008 Aoki
7,458,107 B2 12/2008 Desjardins et al.
7,530,120 B2 * 5/2009 Morrow et al. ..... 2/161.1
7,591,023 B2 9/2009 Béland et al.
7,636,951 B2 12/2009 Morrow et al.
7,861,321 B2 * 1/2011 Winningham ..... 2/161.1
7,900,275 B2 * 3/2011 Morrow et al. ..... 2/161.1
2002/0069445 A1 * 6/2002 Beland et al. ..... 2/16
2003/0101504 A1 * 6/2003 Morrow ..... 2/161.1
2005/0066412 A1 * 3/2005 Morrow ..... 2/161.1
2005/0114984 A1 * 6/2005 Morrow et al. ..... 2/161.1
2005/0273905 A1 * 12/2005 Gait ..... 2/161.1
2006/0206981 A1 * 9/2006 Morrow et al. ..... 2/161.1
2007/0017002 A1 * 1/2007 Morrow ..... 2/161.1
2007/0074332 A1 * 4/2007 Wilder et al. ..... 2/161.1
2007/0245451 A1 * 10/2007 Desjardins et al. ..... 2/159

(Continued)

*Primary Examiner* — Khoa Huynh
*Assistant Examiner* — Andrew W Collins
(74) *Attorney, Agent, or Firm* — Sterne, Kessler, Goldstein & Fox P.L.L.C.

(57) ABSTRACT

A protective sports glove including a hand-receiving portion adapted to receive and enclose a hand of a user, a cuff attached to the hand-receiving portion, and a segmented cuff roll disposed on the outside of the cuff. The cuff roll is divided into two segments connected to each other via an elastic band. The segmented cuff roll is further attached to the hand-receiving portion and the cuff via an elastic band.

30 Claims, 7 Drawing Sheets

(56) References Cited

U.S. PATENT DOCUMENTS

| | | | | |
|---|---|---|---|---|
| 2008/0083048 | A1* | 4/2008 | Morrow et al. | 2/16 |
| 2008/0244797 | A1* | 10/2008 | Winningham | 2/16 |
| 2008/0244799 | A1* | 10/2008 | Winningham | 2/16 |
| 2008/0282439 | A1* | 11/2008 | Sarkies | 2/20 |
| 2008/0313785 | A1* | 12/2008 | Rudd et al. | 2/16 |
| 2009/0019613 | A1* | 1/2009 | Carcaterra et al. | 2/16 |
| 2009/0019618 | A1* | 1/2009 | Winningham | 2/161.1 |
| 2009/0044306 | A1* | 2/2009 | Lamson et al. | 2/16 |
| 2009/0165185 | A1* | 7/2009 | Contant et al. | 2/16 |
| 2009/0217438 | A1* | 9/2009 | Purnell | 2/21 |
| 2009/0300821 | A1* | 12/2009 | Winningham | 2/161.1 |
| 2011/0126342 | A1* | 6/2011 | Bautista | 2/161.1 |

* cited by examiner

PROTECTIVE SPORTS GLOVE HAVING A SEGMENTED CUFF ROLL

BACKGROUND OF THE INVENTION

1. Field of the Invention

The present invention is directed to a protective sports glove having a segmented cuff roll.

2. Background Art

Various protective sporting gloves have been developed over the years for use in lacrosse, hockey, cricket, and other similar contact sports. Protective sports gloves are particularly important to protect a player's hands, wrists, and lower forearms from impacts from the equipment, such as hockey sticks, lacrosse sticks, pucks, balls, skates, and the like, as well as impacts between participants.

Unfortunately, as the protection provided by these gloves increases, the user of these prior art gloves often experiences a reduction in the amount of flexibility he has in his hand due to the configuration of the glove. This reduction in flexibility can substantially reduce the effectiveness and level of play of a participant wearing the glove. There are several areas of the hand in particular that need to maintain an increased level of flexibility and yet still need a high level of protection, such as the various joints of the fingers and hand including the wrist. The wrist area can be especially problematic due to the high degree of flexibility within the wrist. For example, the hand can extend in the direction from the back of the forearm to the palm side of the forearm in a range of approximately 180 degrees. This degree of rotation combined with the size of the wrist and forearm areas that need to be protected through this full range of motion presents increased problems.

In particular, sports like lacrosse and hockey necessitate a substantial range of motion of the wrists for precise manipulation of the stick, and as such flexibility of the gloves around the wrist joints must be maximal. In order to sustain as complete of a range of motion as possible for the hand at the wrist, the padding or protection on the forearm and wrist should not substantially restrict the flexibility of the forearm, wrist and hand.

Many current protective sports gloves utilize cuff rolls to protect a player's wrist between the cuff and the hand portion. The cuff roll is particularly important when a player flexes his or her hands during play, because the area between the cuff and hand portion may otherwise be vulnerable. While most cuff rolls provide adequate protection, they may provide limited flexibility and adjustability and can therefore be uncomfortable. Because of these limitations, they are sometimes removed or not used by players.

Accordingly, there is a need in the art to develop a protective sports glove that provides increased protection for a wearer's hand, wrist, and/or forearm without unduly decreasing flexibility.

BRIEF SUMMARY OF THE INVENTION

In one embodiment, a protective sports glove includes a hand-receiving portion adapted to receive and enclose a hand of a user, a cuff attached to the hand-receiving portion, and a segmented cuff roll disposed on the cuff.

In another embodiment, a protective sports glove includes a hand-receiving portion adapted to receive a hand of a user; a cuff attached to the hand-receiving portion; a segmented cuff roll having a plurality of segments disposed on the cuff; an elastic band connecting the plurality of cuff roll segments; and an inner cuff disposed inside a portion of the cuff.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

The present invention will now be described in detail with reference to embodiments thereof as illustrated in the accompanying figures. While specific configurations and arrangements are discussed, it should be understood that this is done for illustrative purposes only. References to "an embodiment," "one embodiment," "another embodiment," etc., indicate that the embodiment described may include a particular feature, structure, or characteristic, but every embodiment may not necessarily include the particular feature, structure, or characteristic. Moreover, such phrases do not necessarily refer to the same embodiment. Further, a person skilled in the relevant art will recognize that other configurations and arrangements can be used without departing from the spirit and scope of the invention.

Figure 1:
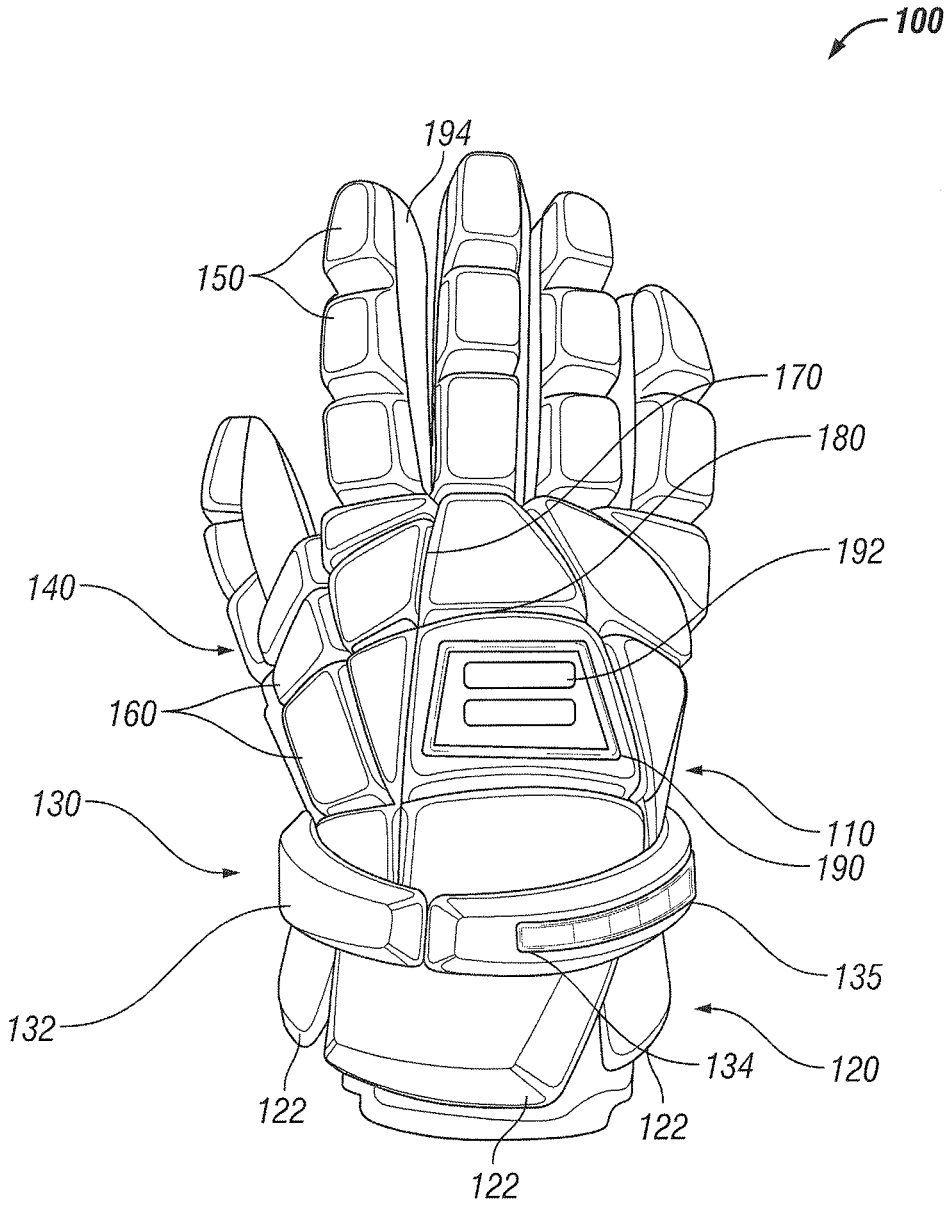
FIG. 1 is a top plan view of a protective sports glove according to an embodiment of the present invention.
Figure 2:
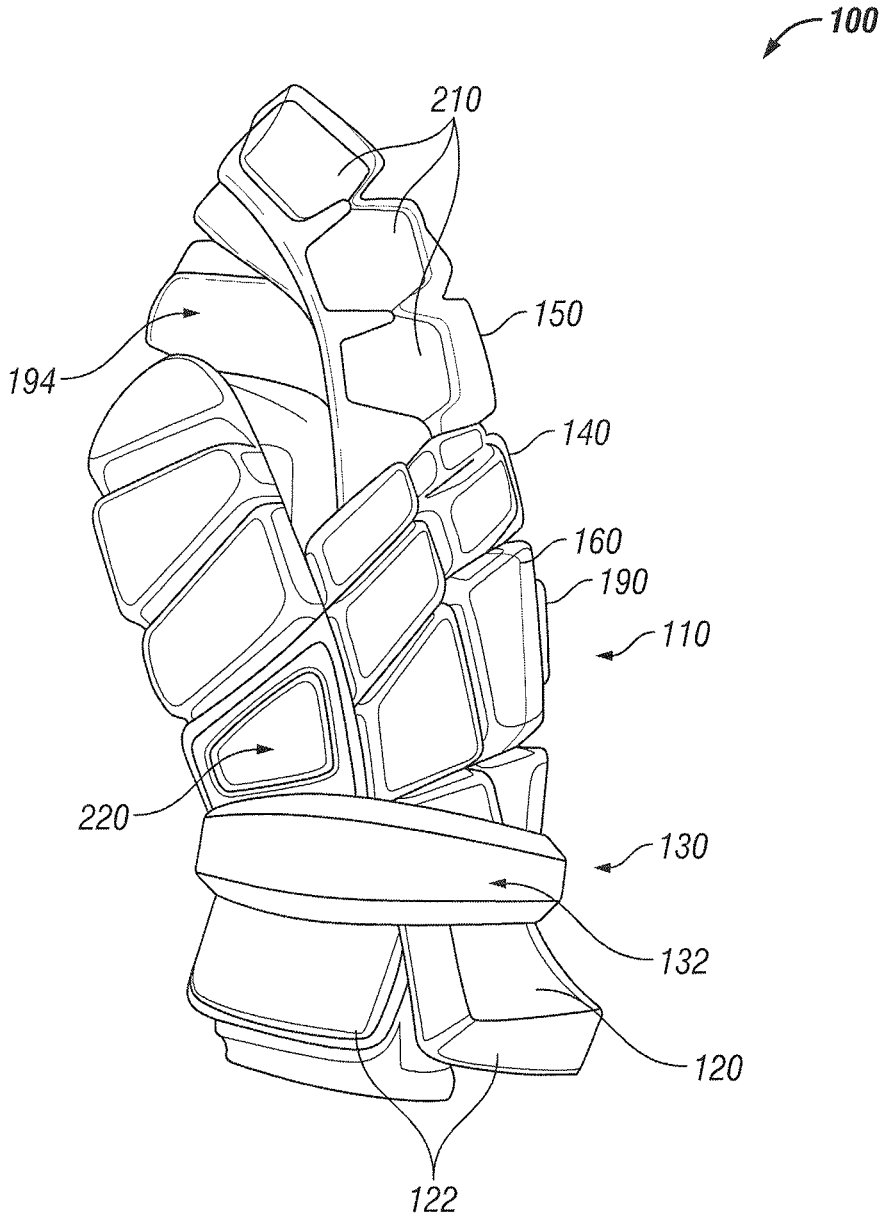
FIG. 2 is a left-side view of the glove of FIG. 1 according to an embodiment of the present invention.
Figure 3:
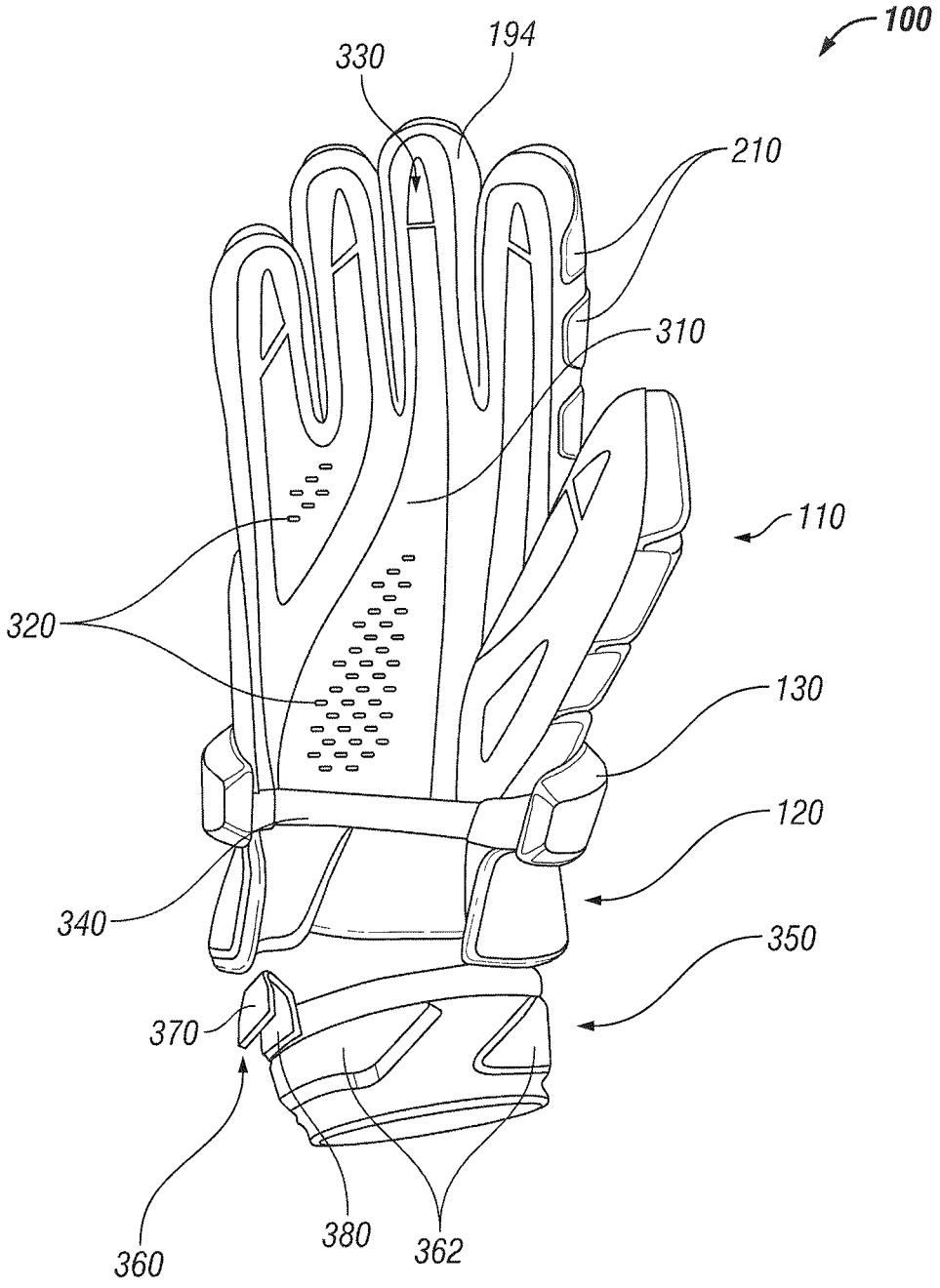
FIG. 3 is a bottom view of the protective sports glove of FIG. 1 with no inner cuff according to an embodiment of the present invention.

In one embodiment, as shown in FIGS. 1-3, protective sports glove 100 includes hand-receiving portion 110 adapted to receive and enclose a hand of a user, cuff 120 attached to the hand-receiving portion, and segmented cuff roll 130 disposed on the outside of cuff 120.

Hand-receiving portion 110 includes palm-receiving portion 310 and backhand portion 140. Palm-receiving portion 310 and backhand portion 140 may be connected to each other via stitching, sutures, adhesives or any other suitable attachment means. Palm-receiving portion 310 and backhand portion 140 may be made of the same or different materials. For example, backhand portion 140 may be heavily padded with a leather, plastic, sharkskin, polyurethane, nylon, or other material exterior, whereas palm-receiving portion 310 may have minimal or no padding and be made of softer leather, leather-like materials, lycra mesh, goatskin, nash fabric, reinforced soft-feel nash fabric, nylon, synthetic suede or other light fabric, or any combination thereof.

In one embodiment, palm-receiving portion 310 may further be configured so that areas subject to the most wear, for example areas intended to have primary contact with a hockey stick, lacrosse stick, or the like, are provided with additional layers of protection and/or may be made of more durable material. Conversely, areas subject to less wear may be made of a less durable material, such as for example a mesh material. For example, as best shown in FIG. 3, palm-receiving portion may include various combinations of materials.

In one embodiment, backhand portion 140 includes an interior moisture management liner to wick moisture away from the palm to keep the user's hands cool and dry. The moisture management liner may further include an anti-bacterial treatment. Palm-receiving portion 310 may or may not include a separate inner liner. This configuration may allow for increased touch, flexibility, and ventilation for the user's hands. Additionally, palm-receiving portions, including, but not limited to, areas corresponding to user's fingers, may include grip-enhancing portions, such as for example grip-enhancing portions 330, configured to improve a user's grip. Palm-receiving portion 310 may further include fabric trim 340 attached to palm-receiving portion 310 via stitching, adhesives, or any other suitable attachment means. In one embodiment, palm-receiving portion may further include seamless finger joints to allow for a more comfortable feel when gripping the stick.

In a preferred embodiment, backhand portion 140 is heavily padded to protect the user. The padding may include foam such as ethylene-vinyl acetate (EVA), modified EVA, EPP foam, gels, rubber, polyethylene, or any other suitable padding material for absorbing the energy of an impact. Padding may be contained within a padding pocket made of leather, knit polyester, PVC, or other suitable materials. Alternatively, or in addition, backhand portion 140 may include a layer of low density padding and a layer of high density padding overlying the low density padding. Backhand portion 140 can include one or more protective materials more rigid or hard than the padding material such as a substantially rigid or hard plastic or metal. In one embodiment, backhand portion 140 includes a padding material with an overlying protective plastic material more rigid or hard than the padding material, for example, backhand portion 140 can include an EVA foam and an overlying more rigid or hard plastic material.

To increase flexibility, the padded areas of backhand portion 140 may further include finger segments 150 corresponding to the joints of a user's fingers and hand segments 160 corresponding to various flexure areas of a user's hands. For example, hand segments 160 may include vertical hand segments 170 and horizontal hand segments 180 that extend from the user's fingers to the user's wrist and allow protective sports glove 100 to conform to a user's hand as it holds a hockey stick, lacrosse stick, or the like. Protective sports glove 100 may further include any other segments or configurations suitable to increase flexibility of padded backhand portion 140. Additionally, any or all of the finger-receiving portions of protective sports glove 100 may be configured to prevent finger hyperextension, for example via a lock thumb configuration, or other suitable configurations.

In one embodiment, backhand portion 140 may further include various ventilation holes or slots, for example, as shown in FIG. 1, logo 190 includes ventilation holes 192. Alternatively, or in addition, backhand portion 140 may include ventilation holes in the form of text, shapes, or other designs suitable for a protective sports glove. Alternatively, a plurality of ventilation areas may be provided on backhand portion 140 in order to provide increased ventilation for a user's hand. In one embodiment, palm-receiving portion 310 includes various ventilation holes 320. It should be understood that more or less ventilation holes or slots may be included and the locations shown are merely exemplary and may vary.

Protective sports glove 100 may include mesh fabric portions 194 on the areas corresponding to the sides of a user's fingers or hand in order to increase ventilation. Preferably, mesh fabric portions are made of lightweight fabric or other suitable material to provide improved ventilation. For additional protection, mesh fabric portions 194 include padding extensions 210 to protect the sides of user's index and pinky fingers. Additional padded extensions may be provided as suitable to further protect the sides of user's hands or any or all of the user's other fingers.

In one embodiment, backhand portion 140 may include a fluid filled bladder, such as, for example, captured air bladder 220. In one embodiment, captured air bladder 220 may be filled with ambient air or pressurized air. In other embodiments, a fluid filled bladder including gel, gas, liquid and/or any other suitable material may be used. Captured air bladder 220 may be made of compressible plastic or other suitable material and may be transparent or opaque. Captured air bladder 220 is a generally rectangular shape but may be any shape or configuration suitable for a protective sports glove. In one embodiment, a plurality of air bladders 220 may be used. One or more of the bladders may be in fluid communication with one or more other air bladders such that air may flow from one bladder to another when subjected to a force. Captured air bladder 220 may provide additional protection, cushioning, style, and/or ornamentation for a protective sports glove.

Cuff 120 is attached to hand-receiving portion 110. Cuff 120 may be a single unitary piece with backhand portion 140 or it may be a separate piece attached to backhand portion 140 via stitching, lacing, buttons, rivets, suturing, adhesives, or any other suitable attachment means. Cuff 120 may have similar materials, segments, lining, padding, etc., as backhand portion 140. Cuff 120 may include one or more logo areas on its outside surface. Cuff roll 130 may also include one or more logo areas on its outside surface, such as logo area 135. In one embodiment, cuff 120 is a multi-segmented, open, flexible cuff, designed for maximum range of motion at the wrist. As best shown in FIG. 2, cuff 120 may flare outward from the user's wrist in order to increase flexibility. Cuff 120 may include various cuff segments 122, which are attached to backhand portion 140 but are not otherwise connected to each other. This configuration provides increased flexibility for a user's wrist. Alternatively, cuff segments 122 may overlap each other to provide further protection. Alternatively, any other configuration suitable to increase flexibility while providing sufficient protection may be used.

Like the padding of backhand portion 140, cuff 120 may be heavily padded to protect the user. The padding may include foam such as ethylene-vinyl acetate (EVA), modified EVA, EPP foam, gels, rubber, polyethylene, or any other suitable padding material for absorbing the energy of an impact. Padding may be contained within a padding pocket made of leather, knit polyester, PVC, or other suitable materials. Alternatively, or in addition, cuff 120 may include a layer of low density padding and a layer of high density padding overlying the low density padding. Cuff 120 can include one or more protective materials more rigid or hard than the padding material such as a substantially rigid or hard plastic or metal. In one embodiment, cuff 120 includes a padding material with an overlying protective plastic material more rigid or hard than the padding material, for example, cuff 120 can include an EVA foam and an overlying more rigid or hard plastic material.

Protective sports glove 100 may be tightened over a user's wrist via laces, hook and loop fasteners (e.g., Velcro®), or any other suitable means. One embodiment of protective sports glove 100 includes an inner cuff 350. As best shown in FIG. 3, inner cuff 350 is adapted to fit securely around a user's wrist to further secure protective sports glove 100 on the user's hand. In one embodiment, inner cuff 350 is made of an elastic material and includes padded segments 362. Padded segments 362 may include any type of padding described herein or any other padding suitable for use in a protective sports glove. Alternatively, inner cuff 350 may not include padded segments or may be a generally inelastic material and may be opened or otherwise expanded to receive a user's wrist. For example, inner cuff 350 may include a zipper, hook and loop fasteners, or any other suitable releasable fastening or expansion means.

Figure 4:
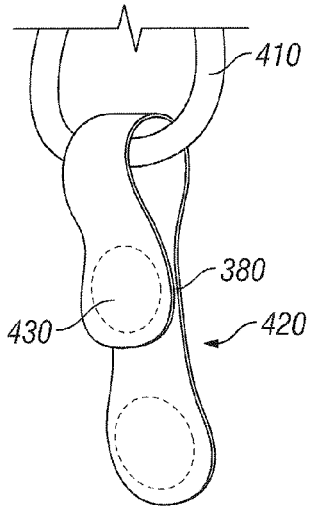
FIG. 4 is a perspective view of a loop and tongue arrangement of an inner cuff roll of the protective sports glove of FIG. 1 according to an embodiment of the present invention.

Inner cuff 350 may be attached to any portion of protective sports glove 100 via stitches, sutures, adhesives, or any other suitable fixed attachment means. Alternatively, inner cuff 350 may be releasably attached to protective sports glove 100. In one embodiment, as best shown in FIG. 4, protective sports glove 100 includes loop 410. In a preferred embodiment, the material of loop 410 is fabric, but it may be made of any suitable material. As shown in FIG. 3, inner cuff 350 includes inner cuff tongue 360. Preferably, inner cuff tongue is leather, but it may be made of any suitable material. Inner cuff tongue 360 includes, for example, a hook and loop fastener having an end 370 and receiving portion 380 and is configured to pass through loop 410. The user can secure inner cuff 350 to protective sports glove 100 via inner cuff tongue 360 by attaching end 370 to receiving portion 380. As shown in FIG. 3, receiving portion 380 is on an end of inner cuff tongue 360, but it may also be located anywhere else suitable on inner cuff tongue 360. In one embodiment, as shown in FIG. 4, receiving portion 430 is located in the middle of inner cuff tongue 420. Additionally, inner cuff tongue 360 may be secured to protective sports glove 100 by any other suitable releasable fastening means, including, but not limited to, a button or a clip.

Segmented cuff roll is disposed on the outside of cuff 120. Segmented cuff roll may be curved to follow the natural contours of a user's wrist. In one embodiment, segmented cuff roll 130 includes two segments, left cuff roll segment 132 and right cuff roll segment 134. In other embodiments, segmented cuff roll 130 may include any number of segments. Further, although left cuff roll segment 132 and right cuff roll segment 134 are shown as being substantially rectangular, segmented cuff roll 130 may include segments having any shape or configuration suitable for a protective sports glove.

Figure 5:
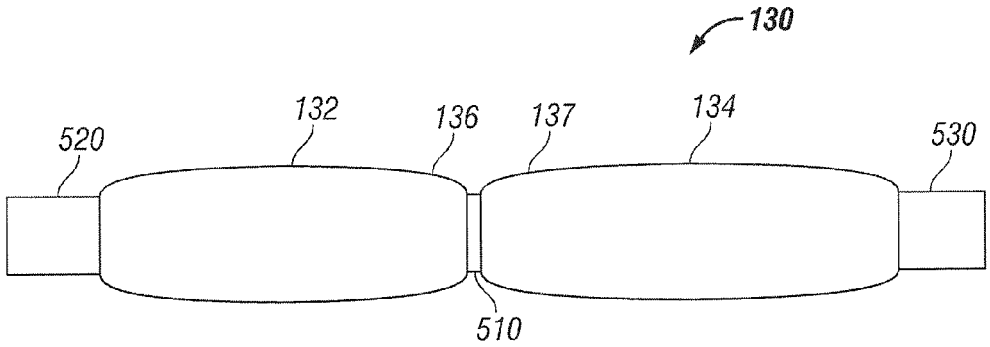
FIG. 5 is a side view of a segmented cuff roll of the protective sports glove of FIG. 1 according to an embodiment of the present invention.

As best shown in FIG. 5, segmented cuff roll 130 includes left cuff roll segment 132, right cuff roll segment 134, segment connecting piece 510, left cuff roll connecting tab 520, and right cuff roll connecting tab 530. In order to provide increased flexibility, left cuff roll segment 132 and right cuff roll segment 134 are preferably separated from each other but connected to each other using segment connecting piece 510. In one embodiment, one or both of the cuff roll segments 132 and 134 may include tapered surfaces 136 and 137. For example, as shown in FIG. 5, cuff roll segment 132 and/or 134 may taper at one or both ends adjacent segment connecting piece 510. The tapered surface may be rounded or may be a straight slanted surface. In one embodiment, cuff roll segments 132 and/or 134 may be substantially flat in between the tapered ends. In another embodiment, the cuff roll segments may be curved in between the tapered ends. The separation between cuff roll segments 132 and 134 and the tapered surfaces may allow adjacent ends of cuff roll segment 132 and cuff roll segment 134 to more freely bend towards each other when segmented cuff roll 130 is subjected to forces. As a result, segmented cuff roll 130 may provide a greater range of motion for the wearer. In one embodiment, segment connecting piece 510 is an elastic band stitched to the left and right cuff roll segments 132 and 134. However, left and right cuff roll segments 132 and 134 may be directly connected to each without the use of segment connecting piece 510, such as, for example via stitching, buttons, rivets, lacing, suturing, adhesives, or any other suitable attachment means. In an alternative embodiment, segmented cuff roll 130 may comprise a unitary piece in which left cuff roll segment 132, right cuff roll segment 134, and segment connecting piece(s) comprise the same material. In this embodiment, segment connecting piece(s) may be thinner than the cuff roll segments 132 and 134, thereby allowing for any desired flexibility of the cuff. In other embodiments, the segments are fully separate.

Further, left cuff roll connecting tab 520 is attached to left cuff roll segment 132 via stitching, lacing, suturing, adhesives, or any other suitable attachment means. In one embodiment, left cuff roll connecting tab 520 is attached to palm-receiving portion 310, but it may be attached to backhand portion 140, or both. For example, it may be attached at separate locations on palm-receiving portion 310 and backhand portion 140 or it may be attached where palm-receiving portion 310 is attached to backhand portion 140. Right cuff roll segment 134 may be likewise attached to protective sports glove 100 via right cuff roll connecting tab 530. In one embodiment, left cuff roll connecting tab 520, right cuff roll connecting tab 530 and segment connecting piece 510 are in the form of a single continuous band that stretches at least the entire length of segmented cuff roll 130.

Figure 6:
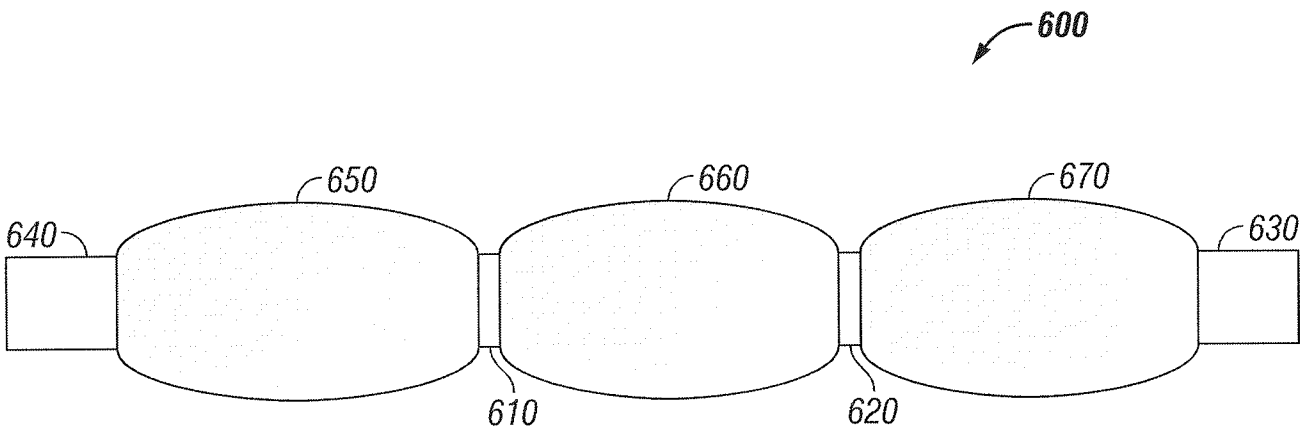
FIG. 6 is a side view of a segmented cuff roll of the protective sports glove of FIG. 1 according to an alternative embodiment of the present invention.

In some embodiments of the segmented cuff roll, the segments are horizontally aligned. For example, as shown in FIG. 6, an alternative embodiment of the segmented cuff roll includes 3 horizontal segments 650, 660, and 670. These segments are connected to each other via 2 segment connecting pieces 510 and are connected to the rest of protective sports glove 100 via left cuff roll connecting piece 640 and right cuff roll connecting piece 630.

Figure 7:
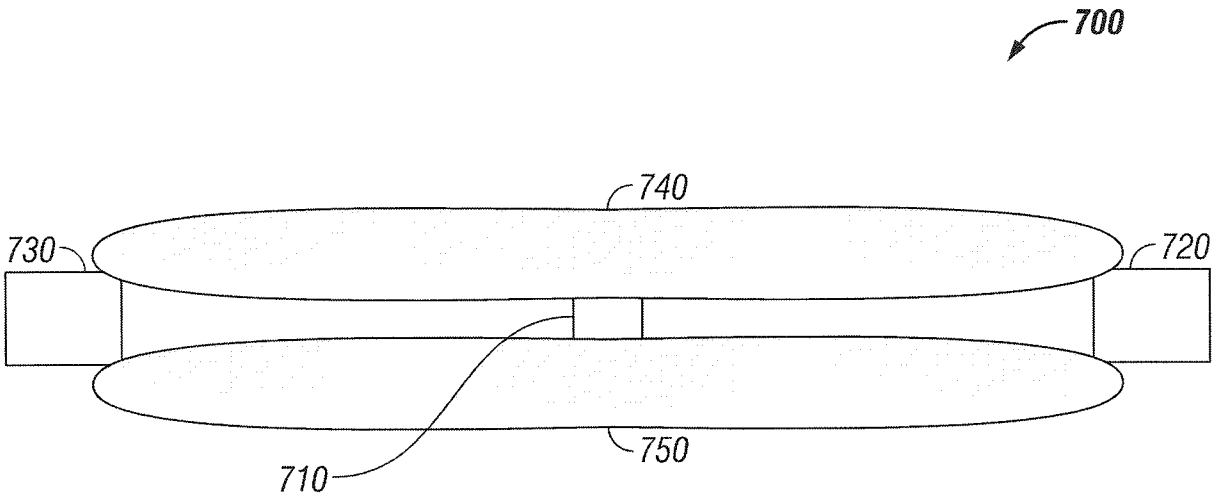
FIG. 7 is a side view of a segmented cuff roll of the protective sports glove of FIG. 1 according to an alternative embodiment of the present invention.

In other embodiments of the segmented cuff roll, the segments are vertically aligned. For example, as shown in FIG. 7, an alternative embodiment of the segmented cuff roll includes 2 vertical segments 740 and 750. These segments are connected to each other via segment connecting piece 710 and are connected to the rest of protective sports glove 100 via left cuff roll connecting piece 730 and right cuff roll connecting piece 720. In addition or in the alternative, vertical segments 740 and 750 may be connected to each other via left cuff roll connecting piece 730 and right cuff roll connecting piece 720.

Figure 8:
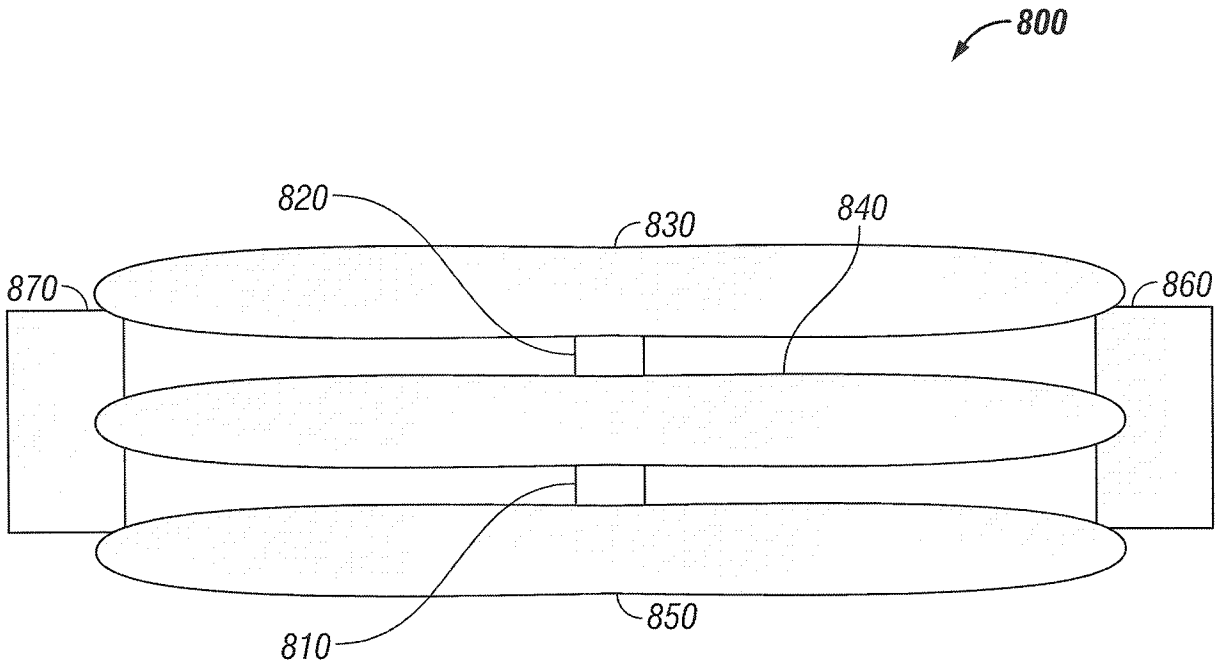
FIG. 8 is a side view of a segmented cuff roll of the protective sports glove of FIG. 1 according to an alternative embodiment of the present invention.

FIG. 8 shows an alternative embodiment of the segmented cuff roll having 3 vertical segments 830, 840, and 850. These segments are connected to each over via 2 segment connecting pieces 810 and 820 and are connected to the rest of protective sports glove 100 via left cuff roll connecting piece 870 and right cuff roll connecting piece 860. In addition or in the alternative, vertical segments 830, 840, and 850 may be connected to each other via left cuff roll connecting piece 870 and right cuff roll connecting piece 860. Accordingly, segmented cuff roll 130 may include any combination or number of vertical, horizontal, or diagonal segments as would be suitable for a protective sports glove.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A protective sports glove, comprising:

a hand-receiving portion adapted to receive and enclose a hand of a user;

a cuff attached to the hand-receiving portion; and a segmented cuff roll including a first cuff roll segment disposed adjacent to a second cuff roll segment, and a connecting piece attached to the first cuff roll segment and the second cuff roll segment;

wherein the first cuff roll segment and the second cuff roll segment are connected via the connecting piece, thereby defining a gap between an outermost lateral end of the first cuff roll segment and an outermost end of the second cuff roll segment; and wherein the connecting piece extends across the gap between the outermost lateral end of the first cuff roll segment and the outermost lateral end of the second cuff roll segment.

2. The protective sports glove of claim 1, wherein the cuff roll is segmented into more than two segments.

3. The protective sports glove of claim 1, wherein the cuff roll is segmented into horizontal segments.

4. The protective sports glove of claim 1, wherein the connecting piece is an elastic band.

5. The protective sports glove of claim 1, wherein the hand-receiving portion, the cuff, and the cuff roll are padded.

6. The protective sports glove of claim 1, wherein the segments of the cuff roll are padded.

7. The protective sports glove of claim 6, wherein the segments are padded with ethylene-vinyl acetate.

8. The protective sports glove of claim 1, wherein the cuff roll is stitched onto the cuff.

9. The protective sports glove of claim 2, wherein the cuff roll is stitched at two locations on the cuff corresponding to the two ends of the cuff roll.

10. The protective sports glove of claim 1, further comprising an inner cuff disposed on the inside of the cuff and attached to at least one of the hand-receiving portion and the cuff.

11. The protective sports glove of claim 10, wherein the inner cuff is configured to be removably attached from the sports glove.

12. The protective sports glove of claim 1, wherein the sports glove is configured to be used for hockey.

13. The protective sports glove of claim 1, Wherein, the sports glove is configured to be used for lacrosse.

14. The protective sports glove of claim 1, wherein the segmented cuff roll is attached to the hand-receiving portion.

15. The protective sports glove of claim 1, wherein the segmented cuff roll is attached to the cuff.

16. The protective sports glove of claim 1, wherein the segmented cuff roll is attached to both the hand-receiving portion and the cuff.

17. The protective sports glove of claim 1, wherein the hand-receiving portion and the cuff are connected to each other at an intersection and the segmented cuff is attached to the band-receiving portion and the cuff at the intersection.

18. The protective sports glove of claim 14, wherein the segmented cuff roll is attached using an elastic band stitched into the hand-receiving portion.

19. The protective sports glove of claim 15, wherein the segmented cuff roll is attached using an elastic band stitched into the cuff.

20. The protective sports glove of claim 16, wherein the segmented cuff roll is attached using an elastic band stitched into the hand-receiving portion and the cuff.

21. The protective sports glove of claim 17, wherein the segmented cuff roll is attached using an elastic band stitched into the intersection.

22. The protective sports glove of claim 9, wherein the two ends of the cuff roll where the cuff roll is stitched to the cuff are a left cuff roll connecting tab and a right cuff roll connecting tab.

23. The protective sports glove of claim 1, further comprising an inner cuff disposed inside a portion of the cuff.

24. A protective sports glove, comprising:

a hand-receiving portion configured to receive and enclose a hand of a user;

a cuff attached to the hand-receiving portion, wherein the cuff includes a first cuff segment disposed adjacent to a second cuff segment thereby defining a gap between an outermost end of the first cuff segment and an outermost end of the second cuff segment, and a cuff roll including a first cuff roll segment disposed adjacent to a second cuff roll segment, and a connecting piece attached the first cuff roll segment and the second cuff roll segment;

wherein the first cuff roll segment and the second cuff roll segment are connected via the connecting piece, thereby defining a gap between an outermost lateral end of the first cuff roll segment and an outermost end of the second cuff roll segment, wherein the connecting piece extends across the gap between the outermost lateral end of the first cuff roll segment and the outermost lateral end of the second cuff roll segment;

wherein, the first cuff roll segment is disposed over the cuff to cover at least a portion of the gap between the first cuff segment and the second cuff segment, and wherein the first cuff segment is disposed under the cuff roll to cover at least a portion of the gap between the first cuff roll segment and the second cuff roll segment.

25. The protective sports glove of claim 24, wherein the cuff roll is segmented into three or more segments.

26. The protective sports glove of claim 24, wherein the connecting piece is an elastic band.

27. The protective sports glove of claim 24, wherein the first cuff roll segment and second cuff roll segment are padded.

28. The protective sports glove of claim 24, Wherein the cuff is attached to the hand-receiving portion at a junction and extends in a distal direction therefrom, and wherein the cuff roll is disposed between the junction and a distal end of the cuff.

29. The protective sports glove of claim 1, wherein the first cuff roll segment and the second cuff roll segment do not overlap.

30. The protective sports glove of claim 24, wherein the first cuff roll segment and the second cuff roll segment do not overlap.

* * * * *

UNITED STATES PATENT AND TRADEMARK OFFICE

CERTIFICATE OF CORRECTION

PATENT NO. : 8,844,064 B2
APPLICATION NO. : 12/874746
DATED : September 30, 2014
INVENTOR(S) : Robaire et al.

It is certified that error appears in the above-identified patent and that said Letters Patent is hereby corrected as shown below:

In the Claims

Claim 1 (column 7, line 30), "an outermost end" should read --an outermost lateral end--.
Claim 13 (column 7, line 62), "...claim 1, Wherein, the..." should read --...claim 1, wherein the...--.
Claim 17 (column 8, line 7), "...the band-receiving portion" should read --"...the hand-receiving portion...--.
Claim 24 (column 8, line 39), "...piece attached the first cuff..." should read --piece attached to the first cuff...--.
Claim 24 (column 8, line 50), "...wherein, the first cuff roll..." should read --...wherein the first cuff roll...--.
Claim 24 (column 8, line 44), "an outermost end" should read --an outermost lateral end--.

Signed and Sealed this
Tenth Day of February, 2015

Michelle K. Lee

Michelle K. Lee
*Deputy Director of the United States Patent and Trademark Office*